US006971282B2

(12) United States Patent
Bathey

(10) Patent No.: US 6,971,282 B2
(45) Date of Patent: Dec. 6, 2005

(54) CONTAINER OPENER

(75) Inventor: Richard A. Bathey, Mission Viejo, CA (US)

(73) Assignee: Wen Dan Enterprises, Inc., Mission Viejo, CA (US)

( * ) Notice: Subject to any disclaimer, the term of this patent is extended or adjusted under 35 U.S.C. 154(b) by 0 days.

(21) Appl. No.: 10/653,851

(22) Filed: Sep. 3, 2003

(65) Prior Publication Data

US 2005/0044995 A1 Mar. 3, 2005

(51) Int. Cl.[7] ..... B27B 7/18
(52) U.S. Cl. ..... 81/3.44; 81/97
(58) Field of Search ..... 81/3.4, 3.42, 3.44, 81/92, 94–99, 3.25, 111, 90.1–90.3; D8/18

(56) References Cited

U.S. PATENT DOCUMENTS 2,463,774 A * 3/1949 Jensen ..... 81/97
5,546,831 A * 8/1996 Grant et al. ..... 81/3.44
6,679,138 B2 * 1/2004 Battles et al. ..... 81/3.44

FOREIGN PATENT DOCUMENTS

EP 0246023 * 11/1987
GB 2162500 * 2/1986

* cited by examiner

*Primary Examiner*—Debra S Meislin
(74) *Attorney, Agent, or Firm*—Stetina Brunda Garred & Brucker

(57) ABSTRACT

A torquing device for assisting in the removal of a lid from a container. The device comprises a housing having a first engagement surface. Moveably mounted to the housing is an engagement member having a second engagement surface. The first and second engagement surfaces collectively define a slot which is sized and configured to accommodate at least a portion of the lid. Cooperatively engaged to the housing and to the engagement member is a biasing member for normally maintaining the engagement member in a release position. The engagement member is selectively moveable from the release position to a gripping position as a result of the rotation of the lid subsequent to the advancement thereof into the slot. The movement of the engagement member to the gripping position facilitates the rigid capture of the lid between the first and second engagement surfaces, thus allowing locking or unlocking torque to be applied thereto.

15 Claims, 2 Drawing Sheets

CONTAINER OPENER

CROSS-REFERENCE TO RELATED APPLICATIONS

Not Applicable

STATEMENT RE: FEDERALLY SPONSORED RESEARCH/DEVELOPMENT

Not Applicable

BACKGROUND OF THE INVENTION

The present invention relates generally to container opening devices, and more particularly, to a lid torquing device having both stationary and pivoting engagement services adapted to collectively facilitate the application of torque to the lid of the container Currently known in the prior art is a wide variety of differently configured containers, many of which are closeable via the removable engagement of the lid thereto. For those containers closeable with a lid, a threaded connection is frequently employed to facilitate the releasable engagement of the lid to the container. More particularly, the container is typically provided with external threads extending about a neck portion thereof, with the lid itself being provided with internal threads which are complimentary to the container threads. To rigidly engage the lid to the container, a sufficient amount of "locking torque" must be applied to the lid. Conversely, a sufficient amount of "unlocking torque" must be applied to the lid to facilitate the disengagement thereof from the container.

It is a relatively common occurrence for an individual to lack the necessary hand strength needed to apply a level of unlocking torque to a lid sufficient to effectively disengage the lid threads from the container threads. This problem is made worse in those situations where a portion of the contents of the container drips over the container threads prior to the engagement of the lid thereto, and subsequently dries or hardens subsequent to such engagement. By way of specific example, when a bottle of nail polish is used, it is relatively common for some of the nail polish to drip onto the threads of the bottle, the nail polish hardening subsequent to the lid being threadably engaged to the bottle. The drying or hardening of the nail polish substantially increases the level of unlocking torque which must be applied to the lid to remove the same from the bottle, the required level of unlocking torque exceeding that which is easily applicable by the hand of a user. Though various devices currently exist in the art which are adapted to assist in the lid removal function by applying unlocking torque to a lid threadably engaged to a container, such devices are typically large in size and cumbersome, and thus not well suited for portability, e.g., being carried in a purse. The present invention addresses this deficiency by providing a lid torquing device which is adapted to apply either locking or unlocking torque to a lid threadably engaged to the container, yet is compact and ergonomically contoured for maximum utility. These, and other features and advantages of the present invention, will be discussed in more detail below.

BRIEF SUMMARY OF THE INVENTION

In accordance with the present invention, there is provided a lid torquing device which may be used to assist in the removal of a lid from a container (e.g., bottle) or alternatively, facilitate the tightening of the lid onto the container. The device comprises a housing having a first engagement surface. Moveably mounted to the housing is an engagement member having a second engagement surface. The first and second engagement surfaces collectively define a slot which is sized and configured to accommodate at least a portion of the lid. Cooperatively engaged to the housing and to the engagement member is a biasing member which normally maintains the engagement member in a release position. The engagement member is selectively moveable from the release position to a gripping position as a result of the rotation of the lid subsequent to the advancement thereof into the slot. The movement of the engagement member to the gripping position facilitates the rigid capture of the lid between the first and second engagement surfaces.

The slot collectively defined by the first and second engagement surfaces is arcuate, and defines opposed first and second ends. The slot is also of decreasing width from the first end to the second end thereof. The engagement member itself preferably comprises a cam which is pivotally or rotatably mounted to the housing, and defines the second engagement surface. The cam pivots about a cam axis, with the second engagement surface defined by the cam being spaced from the cam axis at a first mean radial distance. The first engagement surface defined by the housing is itself spaced from the cam axis at a second mean radial distance which exceeds the first mean radial distance. The biasing member itself preferably comprises a compression spring which extends between the cam and the housing.

The present invention is best understood by reference to the following detailed description when read in conjunction with the accompanying drawings.

BRIEF DESCRIPTION OF THE DRAWINGS

These, as well as other features of the present invention, will become more apparent upon reference to the drawings wherein.

DETAILED DESCRIPTION OF THE INVENTION

Figure 1:
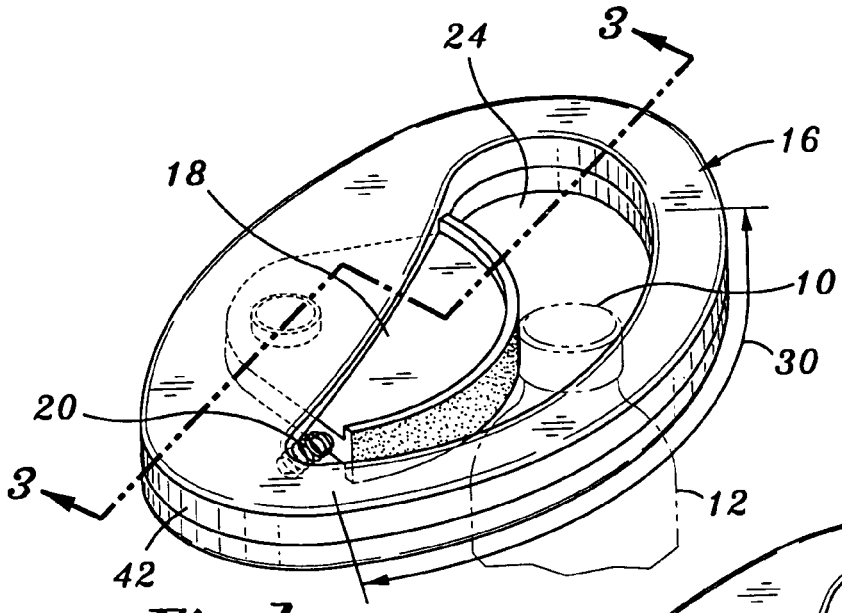
FIG. 1 is a top perspective view of a lid torquing device constructed in accordance with the present invention.

Referring now to the drawings wherein the showings are for purposes of illustrating a preferred embodiment of the present invention only and not for purposes of limiting the same, FIG. 1 perspectively illustrates a lid torquing device 14 constructed in accordance with the present invention. The device 14 is specifically adapted for use in conjunction with a container 12 having a lid 10 threadably engaged thereto. In this regard, it is contemplated that the container 12 will include an externally threaded neck, with the lid 10 being internally threaded, the lid threads being complimentary to the container threads to allow the lid 10 to be threadably engaged to or removed from the container 12. Though the lid threads and container threads of the lid 10 and container 12 will typically follow the right-hand rule, the device 14 constructed in accordance with the present invention may also be used in conjunction with complimentary lid and container threads which follow the left-hand rule.

To facilitate the rigid engagement of the lid 10 to the container 12, a minimum level of locking torque must be applied to the exterior surface of the lid 10. Conversely, a minimum level of unlocking torque is required to remove or unscrew the lid 10 from the container 12. As indicated above, the entrapment of the contents of the container between the lid and container threads and subsequent drying or hardening thereof, often results in a level of unlocking torque having to be applied to the lid 10 to disengage the same from the container 12 which exceeds that easily applicable by a user's hand. This problem is addressed by the device 14 of the present invention which comprises a generally oval-shaped housing 16. The housing 16 itself comprises an upper housing half 42 and a lower housing half 44 which are rigidly attached to each other. The attachment of the upper and lower housing halves 42, 44 to each other may be accomplished through various attachment methods, such as welding, adhesive bonding, or fastening with nuts, bolts or screws.

Figure 2:
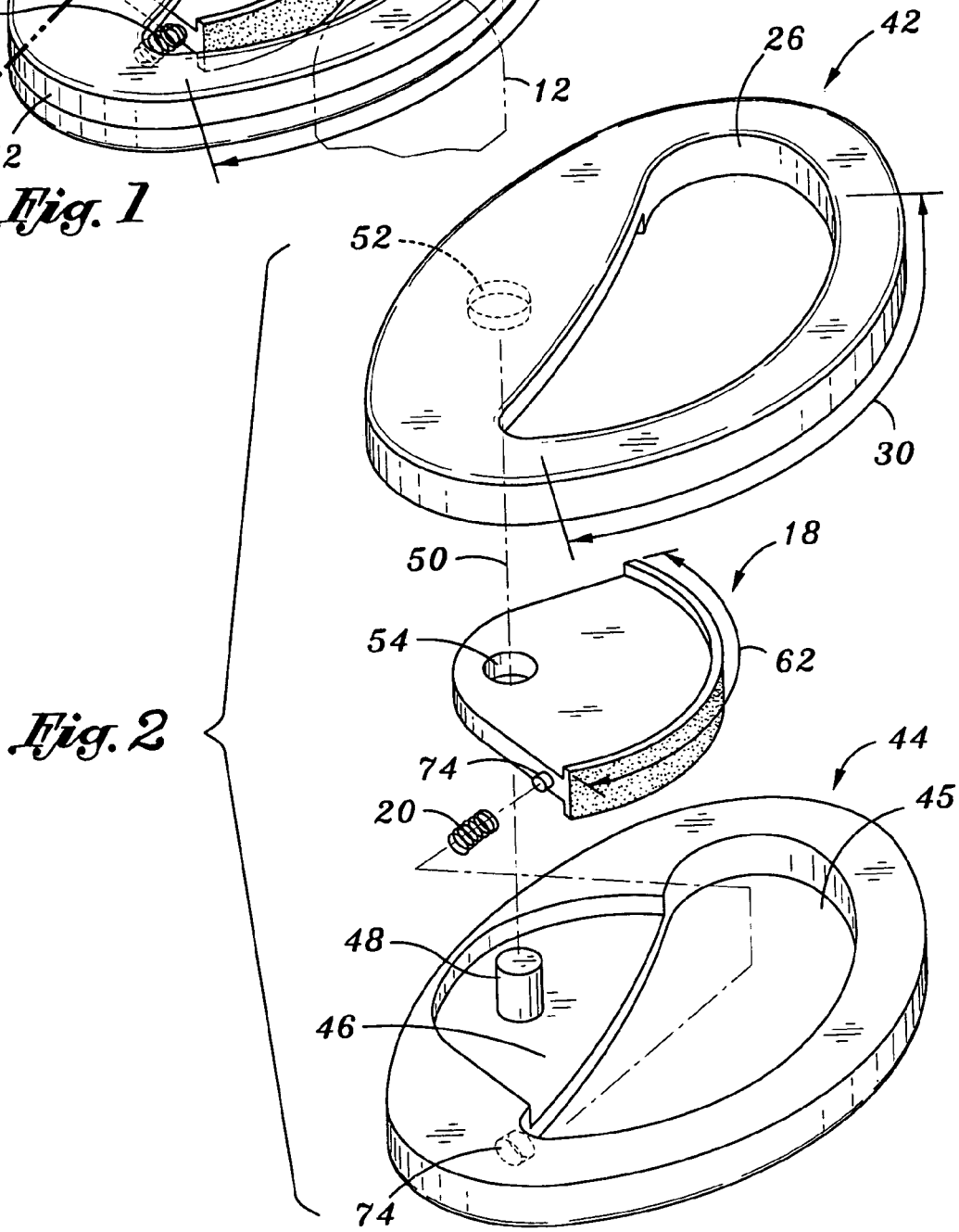
FIG. 2 is an exploded view of the lid torquing device shown in FIG. 1.

As is best seen in FIG. 2, the upper housing half 42 includes an enlarged opening 46 formed therein. In addition to the opening 46, disposed within the upper housing half 42 is an aperture 52. The lower housing half 44 itself includes an opening 45 formed therein. In addition to the opening 45, formed within the lower housing half 44 is a recessed shelf 46 which extends to one edge of the opening 45. Extending perpendicularly upward from the generally planar top surface of the shelf 46 is a cylindrically configured pin 48. Additionally, formed in the side wall of the opening 45 is an aperture 74, the use of which will be described in more detail below.

The device 14 of the present invention further comprises a cam or engagement member 18. The engagement member 18 defines an arcuate, generally convex engagement surface 62. The engagement surface 62 is defined by a flange portion of the engagement member 18 having a width exceeding that of the remainder of the engagement member 18. Disposed within the engagement member 18 is an aperture 54. Additionally, protruding from the peripheral side surface of the engagement member 18 in close proximity to the flange portion thereof is a cylindrically configured pin 72, the use of which will also be described in more detail below.

The device 14 is assembled by advancing the pin 48 of the lower housing half 44 into the aperture 54 of the engagement member 18. The length of the pin 48 exceeds the depth of the aperture 54 such that a portion of the pin 48 protrudes from the aperture 54 when the engagement member 18 is rested upon the shelf 46 defined by the lower housing half 44. When the engagement member 18 is interfaced to the pin 48, the flange portion of the engagement member 18 defining the engagement surface 62 thereof resides within the opening 45 of the lower housing half 44.

Figure 4:
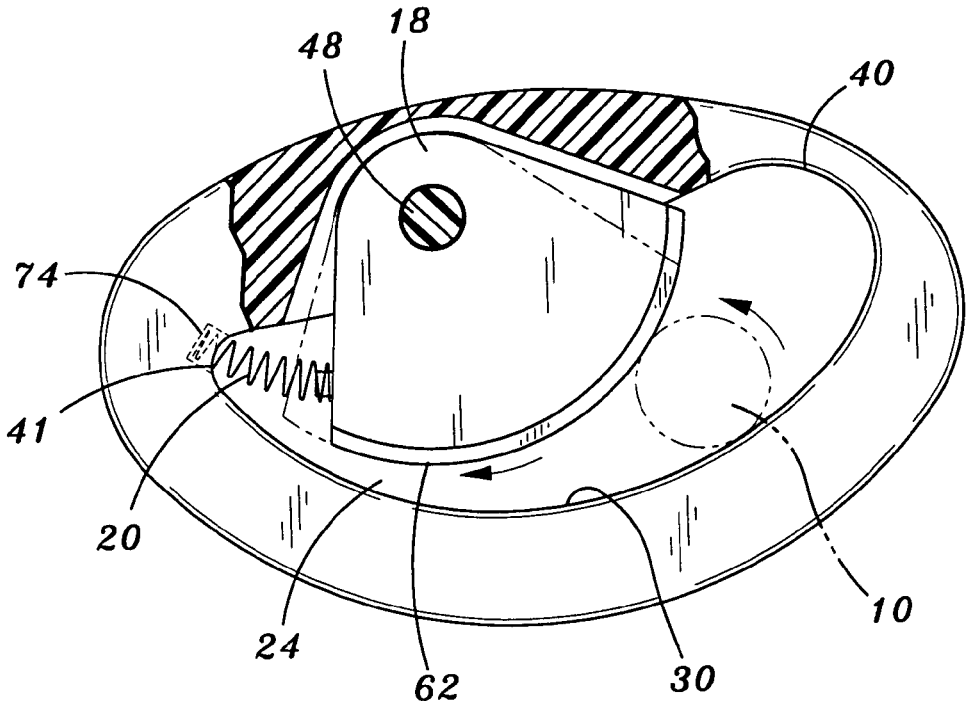
FIG. 4 is a top plan, partial cross-sectional view of the lid torquing device shown in FIG. 1.

Cooperatively engaged to both the engagement member 18 and the lower housing half 44 is a biasing member, and more particularly a compression spring 20. As is seen in FIGS. 1, 2, and 4, one end of the compression spring 20 is advanced into the aperture 74 of the lower housing half 44. The opposite end of the compression spring 20 is advanced over the pin 72 of the engagement member 18. As a result, the compression spring 20 is maintained in a fixed position between the engagement member 18 and the lower housing half 44. As will be discussed in more detail below, the compression spring 20 is operative to normally bias the engagement member to a release position.

Subsequent to the interface of the engagement member 18 to the lower housing half 44 in the above-described manner, the upper housing half 42 is attached to the lower housing half 44. Such attachment is facilitated by the advancement of that portion of the pin 48 protruding from the aperture 54 of the engagement member 18 into the complimentary aperture 52 disposed within the upper housing half 42. As indicated above, the upper and lower housing halves 42, 44 may be firmly secured to each other in any one of a number of different manners, with the attached upper and lower housing halves 42, 44 collectively defining the housing 16 of the device 14. The housing 16, as indicated above, has an oval shape and is ergonomically contoured to be easily graspable by the hand of a user. In this respect, the dimensions of the housing 16 are such that the fingers of the user may easily extend about the continuous peripheral edge 42 defined by the housing 16. Though not shown, it is contemplated that the peripheral edge 42 of the housing 16 may be formed to include finger recesses or detents to further maximize the ability of the user to grip the same.

Figure 3:
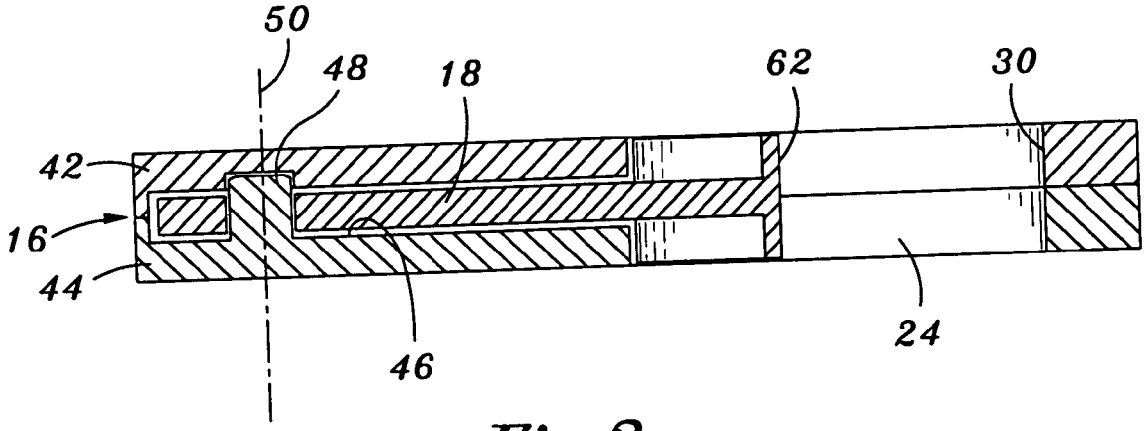
FIG. 3 is a cross-sectional view of the lid torquing device shown in FIG. 1.

When the upper and lower housing halves 42, 44 are attached to each other in the above-described manner, the openings 46, 45 thereof collectively define a slot 24 of the housing 16. A portion of the wall of the housing 16 forming the slot 24 defines an engagement surface 30 of the housing 16. As best seen in FIG. 3, the width of the engagement surface 30 defined by the housing 16 is preferably equal to the width of the engagement surface 62 defined by the engagement member 18, i.e., the opposed longitudinal edges of the flange portion of the engagement member 18 extend in generally co-planar relation to respective ones of the outer surfaces of the upper and lower housing halves 42, 44. As is seen in FIGS. 1 and 4, the slot 24 of the housing 16 has a first end 40 and an opposed second end 41, the aperture 74 being located at the second end 41 of the slot 24. The slot 24 is of gradually decreasing width, with the width at the first end 40 substantially exceeding the width at the second end 41. As will be recognized, the width of the slot 24 at the first end 40 thereof dictates the maximum diameter or dimension of the lid 10 which is advanceable into the slot 24.

When the engagement member 18 is cooperatively engaged to the housing 16 in the above-described manner, the pin 48 and apertures 52, 54 are coaxially aligned along a common engagement axis 50. It is contemplated that the engagement surface 62 of the engagement member 18 will be radially spaced or separated from the engagement axis 50 by a constant distance. One such preferred distance is 1.75 inches. However, those of ordinary skill in the art will recognize that the engagement member 18 may be formed such that different sections or segments of the engagement surface 62 have different radial spacings from the engagement axis 50. Due to the shape of the slot 24, the radial spacing between the engagement surface 30 of the housing 16 and the engagement axis 50 is not constant. Rather, as is most easily seen in FIG. 4, the radial spacing between the engagement surface 30 and the engagement axis 50 increases as the engagement surface 30 moves from the second end 41 of the slot 24 to the first end 40 thereof. It is contemplated that the mean radial distance separating the engagement surface 30 from the engagement axis 50 will be about 2.75 inches.

It is further contemplated that both the engagement surface 30 of the housing 16 and the engagement surface 62 of the engagement member 18 will have a layer of tactile material applied thereto. Such tactile material may comprise, for example, a material having sand or grit embedded therein to increase the frictional resistance between the engagement surfaces 30, 62 and the exterior of the lid 10 when the device 14 is used in the manner which will be described below. The material applied to the engagement surfaces 30, 62 need not necessarily be tactile, but may alternatively have a level of resiliency sufficient to firmly grip or engage the lid 10 when the device 14 is used in its intended manner. Still further, it is contemplated that both the housing 16 and engagement member 18 may be fabricated, in their entirety, from a material having the requisite tactile or gripping characteristics as needed to facilitate the proper functionality of the device 14.

When the device 14 is not being used to apply locking or unlocking torque to the lid 10, the compression spring 20 normally biases the engagement member 18 to a release position which is shown by the solid line depiction of the engagement member 18 in FIG. 4. The device 14 is used by advancing the lid 10 into the slot 24 such that portions of the exterior surfaces of the lid 10 are in contact with both the engagement surface 30 of the housing 16 and the engagement surface 62 of the engagement member 18. As will be recognized, that portion of the slot 24 into which the lid 10 is advanced is dependent upon the size or diameter of the lid 10. In this regard, the smaller the diameter of the lid 10, the closer the same will initially be inserted into the slot 24 toward the smaller second end 41 thereof.

Subsequent to the advancement of the lid 10 into the aperture 24, the housing 16 of the device 14 is rotated. When viewed from the perspective shown in FIGS. 1 and 4, the rotation of the housing 16 in a clockwise direction will facilitate the pivotal or rotational movement of the engagement member 18 toward the second end 41 of the slot 24. In this respect, the biasing force normally exerted against the engagement member 18 by the compression spring 20 is overcome, thus effectively compressing the compression spring and allowing the engagement member 18 to assume the orientation shown by, for example, the phantom lines in FIG. 4. This movement of the engagement member 18 to its gripping position effectively facilitates the rigid clamping or compression of the lid 10 between the engagement surfaces 30, 62. As a result of such clamping or compression, the continued rotation of the housing 16 facilitates the effective application of torque to the lid 10. Whether the applied torque constitutes a locking torque or unlocking torque is dependent upon whether the mating container and lid threads are right-handed or left-handed, and the direction in which the lid 10 is advanced into the slot 24. For example, if the lid 10 is advanced into the slot 24 in the orientation dictated by the position of the container 12 in FIG. 1, the rotation of the housing 16 in the clockwise direction would facilitate the application of locking torque to the lid 10, assuming the container and lid threads are right-handed. Conversely, if the container 12 shown in FIG. 1 and hence the lid 12 thereof were to be flipped over from the orientation shown in FIG. 1, the rotation of the housing 16 in a clockwise direction would facilitate the application of unlocking torque to the lid 10, again assuming that the container and lid threads are right-handed.

Additional modifications and improvements of the present invention may also be apparent to those of ordinary skill in the art. Thus, the particular combination of parts described and illustrated herein is intended to represent only one embodiment of the present invention, and is not intended to serve as limitations of alternative devices within the spirit and scope of the invention.

What is claimed is:

1. An opener for assisting a user in the removal of a lid from a containment vessel, the opener comprising:

an ergonomically contoured housing defining a peripheral edge which is configured to be graspable by a hand of the user and having a first engagement surface circumscribed by the peripheral edge; and an engagement member movably mounted to the housing and having a second engagement surface circumscribed by the peripheral edge, the first and second engagement surfaces collectively defining an elongate slot which extends through the housing and is sized and configured to accommodate at least a portion of the lid, the slot being of a decreasing width from a closed first end to a second end, with the closed first end being operative to maintain the lid within the slot; and a biasing member cooperatively engaged to the housing and the engagement member for normally maintaining the engagement member in a release position;

the engagement member being selectively moveable from the release position to a gripping position as a result of the rotation of the lid subsequent to the advancement thereof into the slot, the movement of the engagement member to the gripping position facilitating the rigid capture of the lid between the first and second engagement surfaces.

2. The opener of claim 1 wherein the slot is arcuate.

3. The opener of claim 1 wherein the engagement member is a cam which is pivotally mounted to the housing and defines the second engagement surface.

4. The opener of claim 3 wherein:

the cam pivots about a cam axis;

the second engagement surface defined by the cam is spaced from the cam axis at a first mean radial distance;

the first engagement surface defined by the housing is spaced from the cam axis at a second mean radial distance; and the first mean radial distance is about 1.75 inches, with the second mean radial distance being about 2.75 inches.

5. The opener of claim 1 wherein the biasing member is a compression spring.

6. The opener of claim 1 wherein the housing is fabricated from a material exhibiting tactile characteristics.

7. The opener of claim 1 wherein the first and second engagement surfaces are defined by first and second layers of a tactile material attached to the respective ones of the housing and the engagement member.

8. The opener of claim 1 wherein the engagement member moves along an arcuate path between the release position and the gripping position.

9. A lid torquing device for applying torque to a lid engageable to a container, the device comprising:

a housing having a stationary engagement surface; and an engagement member pivotally coupled to the housing and having a rotating engagement surface, the stationary and rotating engagement surfaces collectively defining an elongate slot which extends through the housing, accommodates the lid and is of a decreasing width from a closed first end to a second end, the stationary and rotating engagement surfaces being operative to apply torque to the lid when the engagement member is actuated from a release position to a gripping position, the closed first end being operative to maintain the lid within the slot.

10. The device of claim 9 wherein the rotating engagement surface has a convex configuration.

11. The device of claim 10 wherein the stationary engagement surface has a concave configuration.

12. The device of claim 9 wherein the stationary and rotating engagement surfaces each have a layer of a tactile material adhered thereto.

13. The device of claim 9 wherein the housing defines an external surface which is ergonomically sized and configured to fit a user's hand.

14. The device of claim 9 further comprising a biasing member cooperatively engaged to the engagement member and to the housing and operative to normally bias the engagement member to the release position.

15. The device of claim 14 wherein the biasing member is a compression spring.

* * * * *